United States Patent [19]

Vannette

[11] Patent Number: 5,074,063

[45] Date of Patent: Dec. 24, 1991

[54] UNDERCUT TRENCHING MACHINE

[75] Inventor: Avert W. Vannette, Pella, Iowa

[73] Assignee: Pella Engineering & Reseach Corporation, Pella, Iowa

[21] Appl. No.: 528,429

[22] Filed: May 25, 1990

Related U.S. Application Data

[63] Continuation of Ser. No. 360,477, Jun. 2, 1989, abandoned.

[51] Int. Cl.[5] ..... E02F 3/14

[52] U.S. Cl. ..... 37/191 A; 37/80 R

[58] Field of Search ..... 37/80 R, 191 A, 192 A, 37/142 R, 83-90; 405/154, 174-182, 162-164, 267; 414/718; 299/41, 63, 82-84

[56] References Cited

U.S. PATENT DOCUMENTS

| | | | |
|---|---|---|---|
| 946,609 | 1/1910 | Loomis | 405/179 X |
| 2,093,148 | 9/1937 | Hoofnagle et al. | 37/191 A |
| 2,309,712 | 2/1943 | Philbrick | 37/104 |
| 2,681,517 | 6/1954 | Schmidt | 37/104 X |
| 3,390,794 | 7/1968 | McMullen et al. | 414/718 X |
| 3,436,848 | 4/1969 | Peppin et al. | 37/104 |
| 3,932,951 | 1/1976 | Scott et al. | 37/191 A |
| 3,979,843 | 9/1976 | Nissen | 37/191 A |
| 4,043,135 | 8/1977 | Moes et al. | 37/86 X |

*Primary Examiner*—Dennis L. Taylor
*Assistant Examiner*—J. Russell McBee
*Attorney, Agent, or Firm*—Kent A. Herink; Brian J. Laurenzo

[57] ABSTRACT

An undercut trenching machine for digging a ground trench and removing the spoil therefrom wherein the trench is advanced first at the bottom. A cutter chain is carried on a cutter bar that is mounted at its upper end for pivotal movement on a drive unit. A tractor unit is operatively connected to the drive unit by an extensible and retractable boom. In operation, the cutter bar is inclined downwardly and forwardly of the drive unit so that earth is cut or loosened along the upwardly and forwardly facing edge of the cutter. Spoil is conveyed atop the cutter chain to the drive unit which diverts it to either side of the trench.

6 Claims, 9 Drawing Sheets

70
68a
68b
62b
60b
60c
68c
64c
68d
62d
68e
64d
68f
62e
68g
64e
62
64
66
60f
7b
7b
68d
62d
66d
60d
68e
64d
68a
68b
68c
68e
65
68g
63
61
64
66
52
54
63
65
60
48
68
56

BOOM LIFT CYLINDERS
BOOM EXT CYLINDER
CUTTER BAR POSITION CYLINDERS
REMOTE DRIVE LEVELING CYLINDER
DIGGER MOTORS
CONVEYOR MOTOR
LEFT TRACK MOTOR
RIGHT TRACK MOTOR
CONTROLLER A
CONTROLLER B
CONTROLLER C
CONTROLLER D
PORT A
PORT B
72
74
76
78
80
82
34
44
46
50a
50b
58
84a
84b
84c
84d
92
94
96

UNDERCUT TRENCHING MACHINE

BACKGROUND OF THE INVENTION

This application is a continuation of application Ser. No. 360,477, filed June 2, 1989, now abandoned.

The invention relates generally to trenching machines and, more specifically, to a trenching machine wherein the trench is advanced earliest at the bottom.

Conventional trenching machines employ, typically, a cutter bar which carries an endless cutter chain that is powered to travel around the cutter bar. A tractor unit carries the cutter bar which, in its operative position, extends downwardly and rearwardly relative to the direction of travel of the tractor unit. The cutter chain removes earth to create the trench generally along the forward and downward facing edge or face of the cutter bar. The chain travels in a direction to drag spoil fowardly and upwardly where appropriate means are used to divert it to the side of the trench.

Because the cutter chain of conventional trenching machines cuts into the earth along the forward and downward facing edge of the cutter bar, several disadvantages result. Spoil is dragged, rather than carried, to the surface along the face of the trench being cut. The reaction force exerted on the cutter chain is downward and rearward and so has a large component in the direction opposite to the tractive force being exerted by the tractor unit, which must, accordingly, expend additional energy to overcome this rearward force. Rocks and other aggregate material are forced forwardly and downwardly, making their release and transport to the surface more difficult. These same forces tend to compact the earth forwardly of the cutter bar, thereby making the trenching operation more difficult.

Conventional trenching machines also accumulate considerable spoil in the cutting area below the chain. Excess spoil passes around or through the chain and is conveyed upwardly toward the drive sprocket of the cutter bar where it may interfere with the driving of the sprocket and chain and may even wedge in to stop or break either structure. To the extent that the chain of conventional trenching machines acts as a conveyor, spoil carried by the chain may overrun the sprocket and be dumped back into the trench. Considerable force is often applied to the cutter bar to improve the cutting action of the chain, particularly when initiating the trench. This force reduces the stability of the tractor unit and can cause severe vibration in the machine and sideways tipping.

SUMMARY OF THE INVENTION

The invention is an undercut trenching machine having a cutter bar which, in its operative position, extends downwardly and forwardly relative to the direction of travel of the machine to advance the trench first at the lower end portion of the cutter bar. The undercut trencher machine includes a ground-supported tractor unit and a remote drive unit operatively connected thereto by an extensible and retractable boom. A cutter bar is mounted for pivotal movement on the remote drive unit and carries an endless cutter chain. A drive sprocket of the cutter bar engages the chain to provide for travel of the chain about the cutter bar and is drivably rotated by a hydraulic motor or other suitable means.

The cutter bar is pivotable to any downwardly inclined position between horizontal extended rearwardly of the tractor unit and horizontal extended in the direction of travel of the tractor unit. In its normal operative position, the cutter bar is inclined downwardly and forwardly of the remote drive unit. The cutter chain presents a repeating pattern of cutter teeth for the removal of earth to create the trench. The cutter teeth are mounted on shoes or boxes attached to links of the cutter chain and which combine to form conveyor cavities for transporting spoil above ground where it is conveyed to either side of the trench.

The remote drive unit and cutter bar are movable to a stable transport position wherein the free end portion of the cutter bar is supported on the tractor unit.

There is, accordingly, provided a trenching machine which cuts into the earth along the upward and forward facing surface of the cutter bar to provide for improved fracturing and less compacting of the earth to be removed. In contrast to conventional trenching machines, the horizontal reaction force component on the cutter chain is in the direction of travel of the tractor unit thereby reducing the amount of energy required to move the machine fowardly during trenching. Spoil removed from the trench is carried or conveyed to the surface rather than being dragged against the earth being cut, permitting the speed of the chain to be reduced. Spoil is less likely to be carried into the drive sprocket and recirculation of spoil back into the trench is reduced. Stability of the trencher during operation is improved by the orientation of the cutter bar and stability during transport is also improved by retracting the cutter bar and remote driving unit and supporting of the free end of the cutter bar on the tractor unit thereby moving the center of gravity of the cutting mechanism closer to the tracks or wheels of the tractor unit.

DETAILED DESCRIPTION OF A PREFERRED EMBODIMENT

Figure 1:
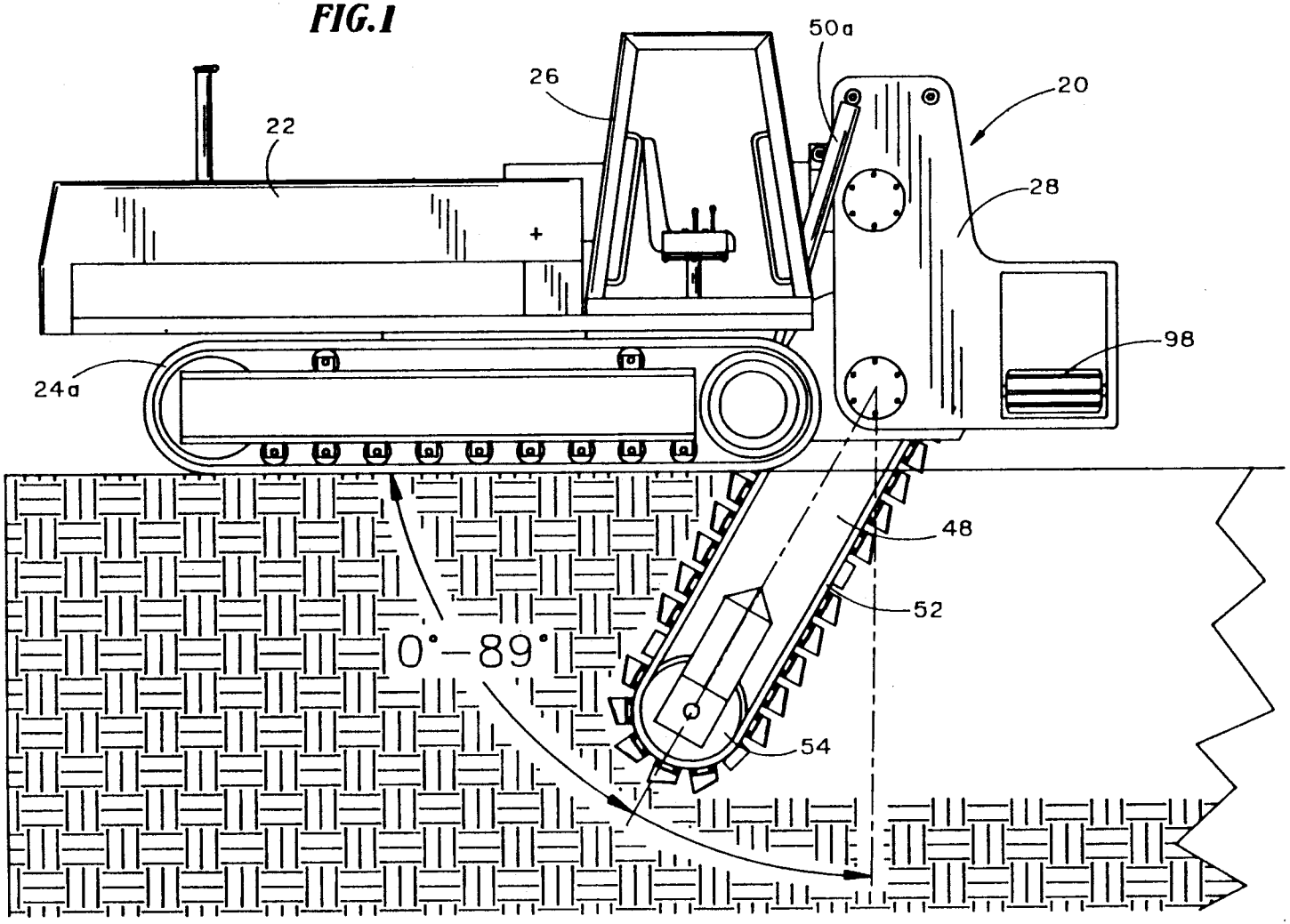
FIG. 1 is a side view of the undercut trenching machine in its operational position with the earth shown in cross-section to illustrate the cutter bar and cutter chain of the machine.
Figure 2:
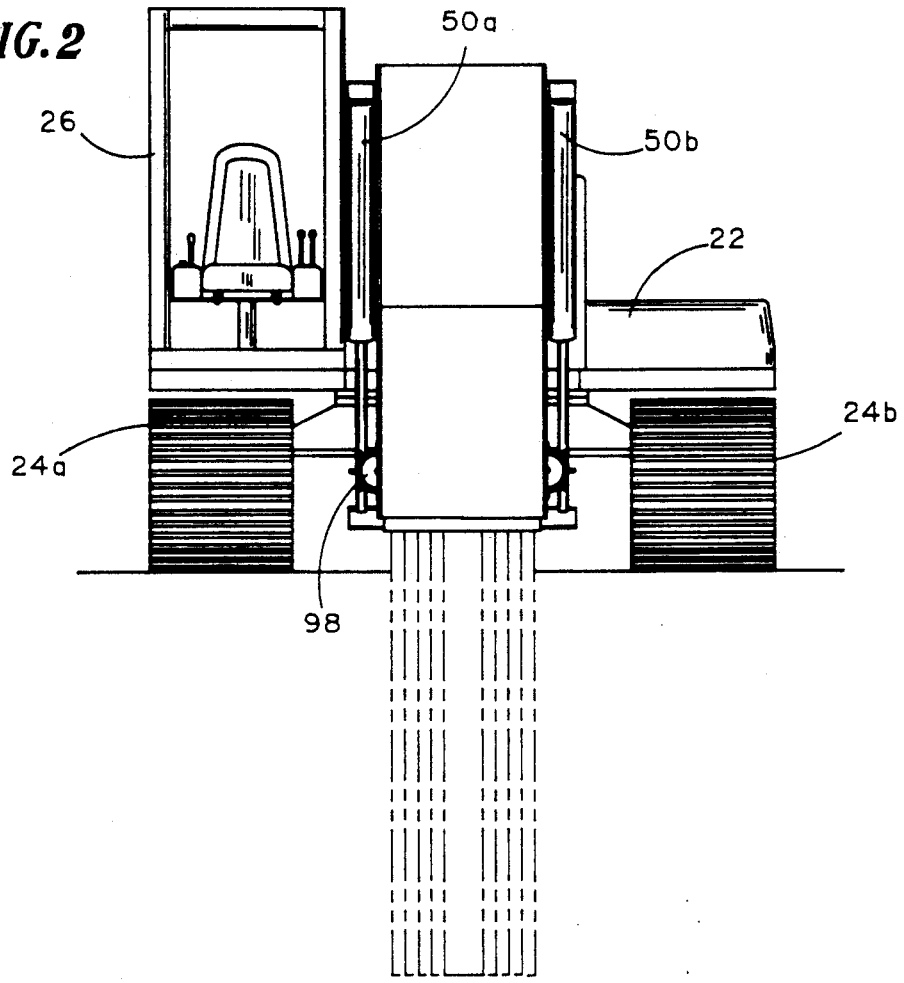
FIG. 2 is a rear view of the undercut trenching machine in FIG. 1 with the plurality of trench widths that may be cut by the trenching machine shown in broken line.

An undercut trenching machine, illustrated in FIG. 1 generally at 20, includes a ground supported prime mover or tractor unit 22 mounted on a pair of tracks 24*a* and 24*b* (FIG. 2). While tracks are described in the preferred embodiment, pneumatic tires are intended for use, as well, particularly with smaller versions of the trenching machine. An internal combustion engine or other suitable means supplies power to drive the tracks 24*a* and 24*b* in a manner to be described more fully below. The tracks 24*a* and 24*b* thus provide a tractive force for moving the undercut trenching machine 20. A cab 26 is provided for an operator and in which are located the controls of the trencher.

Figures 3, 3A, 3B:
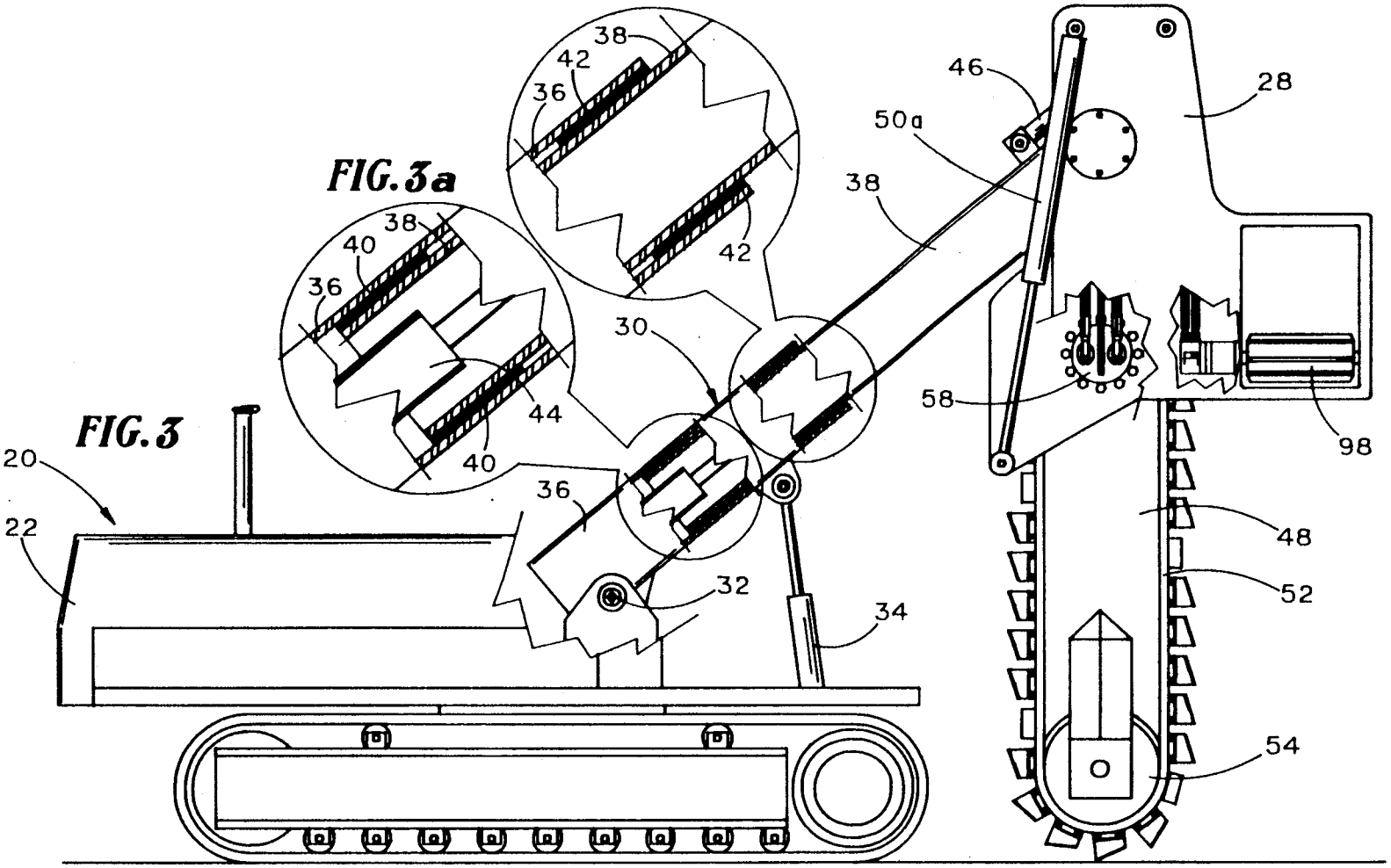
FIG. 3 is a side view of the undercut trenching machine with the cutter bar retracted above the ground and with parts of the boom broken away to show enlarged in FIGS. 3*a* and 3*b* the telescoping structure of the boom.

As best illustrated in FIG. 3, a remote drive unit 28 is operatively connected to the tractor unit 22 by a telescoping extensible and retractable boom 30. The boom 30 is mounted on the tractor unit 22 for pivotal movement about an axis at 32. A pair of boom lift hydraulic cylinders 34 are extensible and retractable to pivot the boom 30 about the axis 32. Extension and retraction of the boom 30 is achieved by relative movement of two telescoping sections, base section 36 and inner section 38. A bushing 40 is fixed to the exterior of the inner section 38 and a bushing 42 is fixed to the interior of the base section 36. The bushings 40 and 42 provide bearing surfaces for sliding support of the inner section 38. Extension and retraction of the inner section 38 relative to the base section 30 is accomplished by a boom extension hydraulic cylinder 44 mounted inside the base section 36 and connected to the inner section 38.

The remote drive unit 28 is pivotally attached to the outer end portion of the boom 30. Relative pivotal movement between the boom 30 and the remote drive unit is effected by a leveling hydraulic cylinder 46 which interconnects between the boom 30 and the remote drive unit 28. A conveyor 98 (FIG. 2) is located at the rear portion of the drive unit 28 and which, as described more fully below, diverts spoil from the trench to either side of the trench.

A cutter bar 48 is pivotally attached to the remote drive unit 28. A pair of cutter bar position hydraulic cylinders 50*a* and 50*b* (FIG. 2) are extensible and retractable to pivot the cutter bar 48 relative to the remote drive unit 28. An endless cutter chain 52 is carried on an idler roller 54 and a drive sprocket (element 56 in FIG. 7) of the cutter bar 48 for travel about the cutter bar 48. A pair of chain drive hydraulic motors 58 mounted in the remote drive unit 28 provide power to rotate the drive sprocket 56 and move the cutter chain 52.

Figure 6:
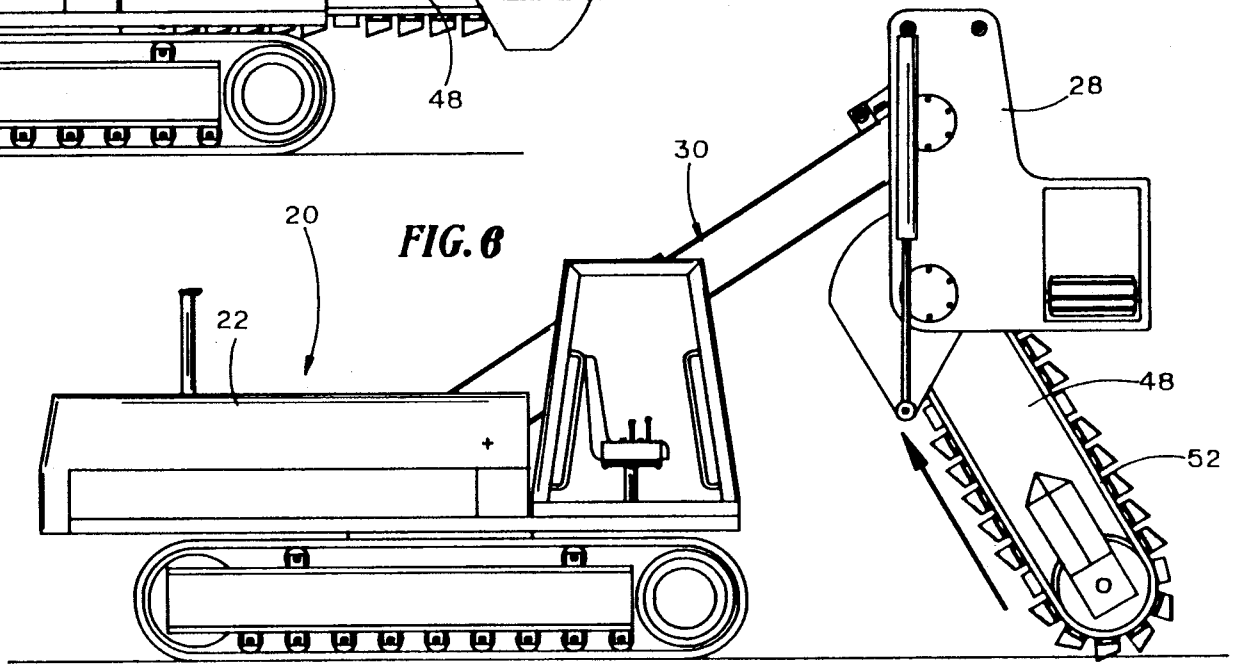
FIG. 6 is a side view showing the cutter bar extended rearwardly of the tractor unit.

Extension of the cutter bar position cylinders 50*a* and 50*b* pivots the cutter bar 48 rearwardly relative to the remote drive unit 28, as illustrated in FIG. 6. Alternatively, retraction of the cutter bar position cylinders 50*a* and 50*b* will pivot the cutter bar 48 forwardly relative to the remote drive unit 28.

Figure 5:
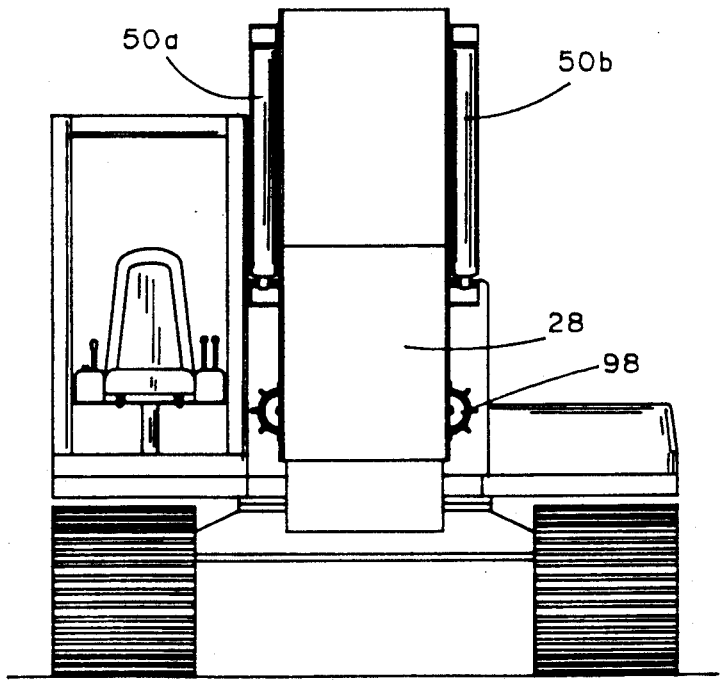
FIG. 5 is a rear view corresponding to FIG. 4.
Figure 4:
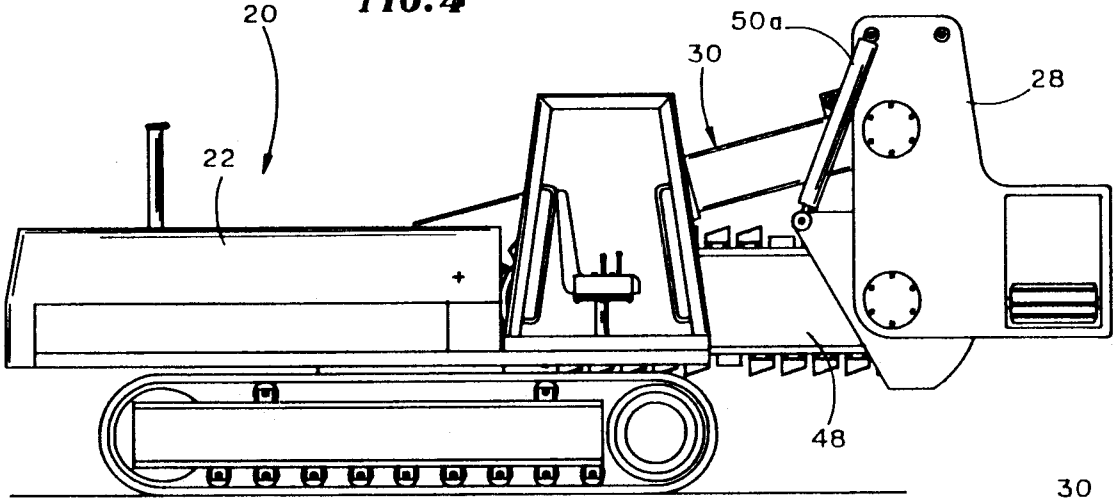
FIG. 4 is a side view of the undercut trenching machine with the remote drive unit and cutter bar shown in the transport position therefor.

Upon full retraction of the cutter bar position cylinders 50*a* and 50*b*, the boom 30 can be retracted and lowered to move the cutter bar 48 and remote drive unit 28 into the transport position therefor, as illustrated in FIGS. 4 and 5.

Figures 7, 7A, 7B, 7C:
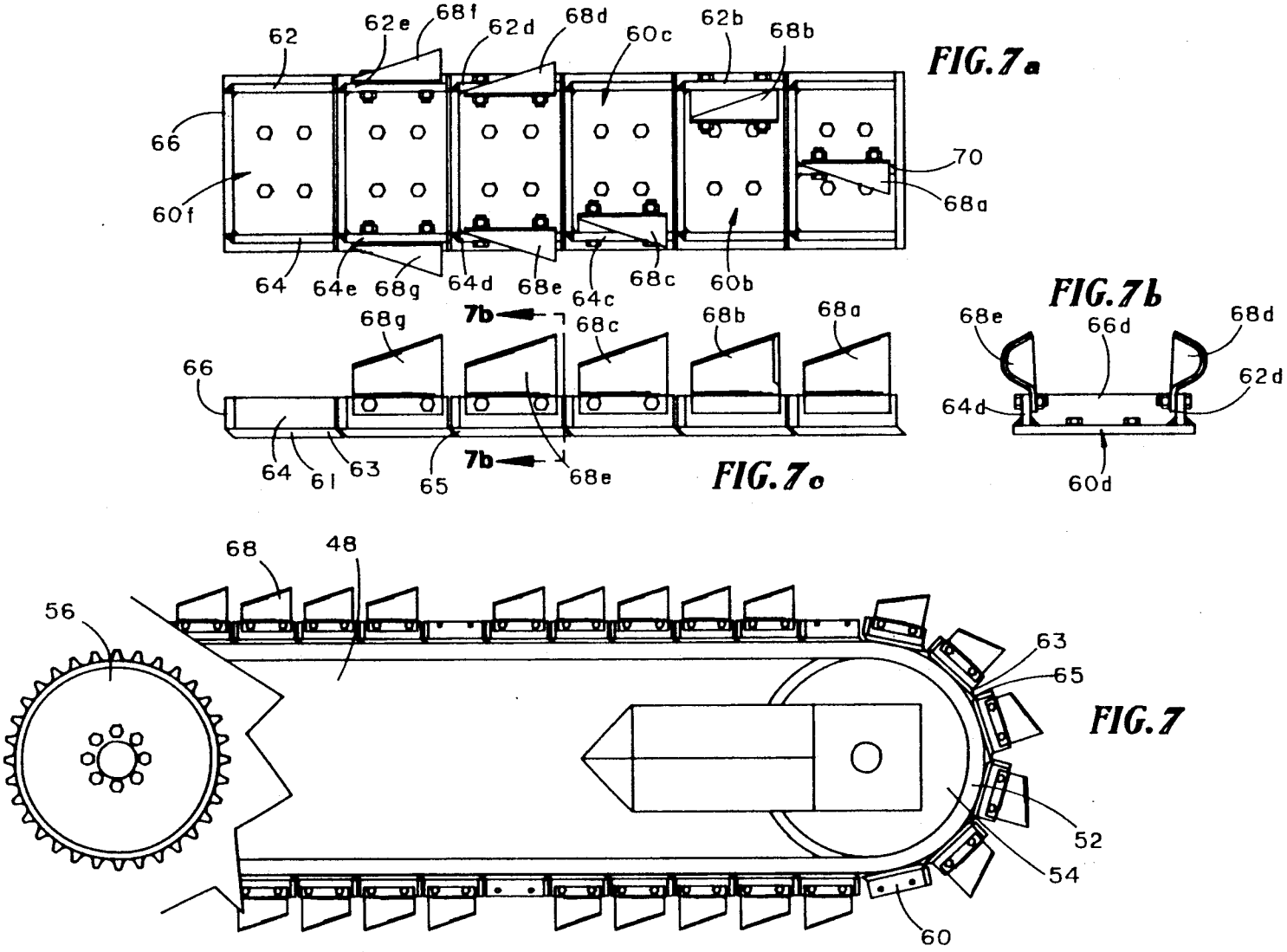
FIG. 7 is an enlarged partial view of the cutter bar wherein partial and further enlarged views show a plan view of the box assemblies-attached to links of the cutter chain in FIG. 7*a*, an end view in FIG. 7*b*, and a side view in FIG. 7*c*.

A plurality of links of the cutter chain 52, as best illustrated in FIG. 7, are engaged by the teeth of drive sprocket 56. Attached to the links are a plurality of three-sided boxes or shoe assemblies 60. Each box 60 is formed of a base 61, two side portions, 62 and 64, and a rear portion 66 that are welded or otherwise fixed to the base 61 and at their corner junctures (FIGS. 7*a* and 7*b*). One or more cupped teeth 68 may be attached to the boxes 60, preferably by releasable attachment means, such as bolts and nuts, that will permit worn or damaged teeth to be conveniently replaced. Additional vertical standards 70 may be welded to the base 61 of each box 60 inwardly of the side portions 62 and 64 to provide additional attachment sites for cupped teeth 68. Of course, any other suitable means for cutting or fracturing the earth may be substituted for the cutter teeth 68. For example, rotary carbide tipped cutting teeth may be used if particularly hard or rocky soil is being trenched.

In the preferred embodiment, the cupped teeth are arranged in a repeating pattern that begins with a single cupped tooth 68*a* attached to a vertical standard 70 which has been welded approximately on the center line of the base 61 of the box 60*a*. The next box 60*b* has a single cupped tooth 68*b* attached to the side portion 62*b*. Note that the base or attachment portion of cupped tooth 68*b* has been extended inwardly to move the cupped tooth 68*b* closer to the center line of the box 60*b*. Similarly, a cupped tooth 68*c*, having an inwardly extended base portion, is attached to the inside surface of side portion 64*c* of the next box 60*c*. Cupped teeth 68*d* and 68*e* are attached to the inside surface of side portions 62*d* and 64*d* of the succeeding box. The pattern is completed by attachment of cupped teeth 68*f* and 68*g* to the outside surface of side portions 62*e* and 64*e*. Each succeeding box of the repeating pattern, accordingly, cuts somewhat wider than the preceding box proceeding from a single, medially located tooth on the first box of the repeating pattern to the maximum width wherein the cupped teeth are attached on the outside surface of the side portions of the penultimate box in the repeating pattern. A blank box 60*f* follows the box with the widest setting of teeth to provide a receptacle for conveying spoil not captured by the preceding box.

The pattern of teeth described in the preferred embodiment may be varied to permit trenches of widths less than the maximum width to be cut by the trenching machine. The pattern of teeth, moreover, may be comprised of fewer or more boxes. Trenches of adjustable width are illustrated schematically in FIG. 2 by broken lines.

An important feature of the boxes 60 are the mating bevels 63 and 65 that are formed in the leading edge and following edge, respectively, of the base portions 61 of the boxes 60. As best illustrated in FIG. 7*c*, the bevels 63 and 65 permit adjacent boxes to be closely spaced in straight runs of the cutter chain to prevent spoil from passing through and possibly interfering with the operation of the trencher. On curved runs of the cutter chain, as illustrated in FIG. 7, the gap between adjacent boxes increases and spoil may enter the gaps. Upon returning to a straight run, however, the wiping action of the bevels 63 and 65 will act to clear intervening spoil. In conventional cutter chains, edges of the base plates are square so that spoil can pass directly between adjacent base plates, particularly at curved runs of conventional chains where the gap is much larger than with the beveled edges of the boxes 60. After a curved run of the chain, intervening spoil will be pinched between adjacent edges as it returns to a straight run, thereby interfering with the efficient operation of the cutter chain.

Figures 8, 9A, 9B, 9C, 9D:
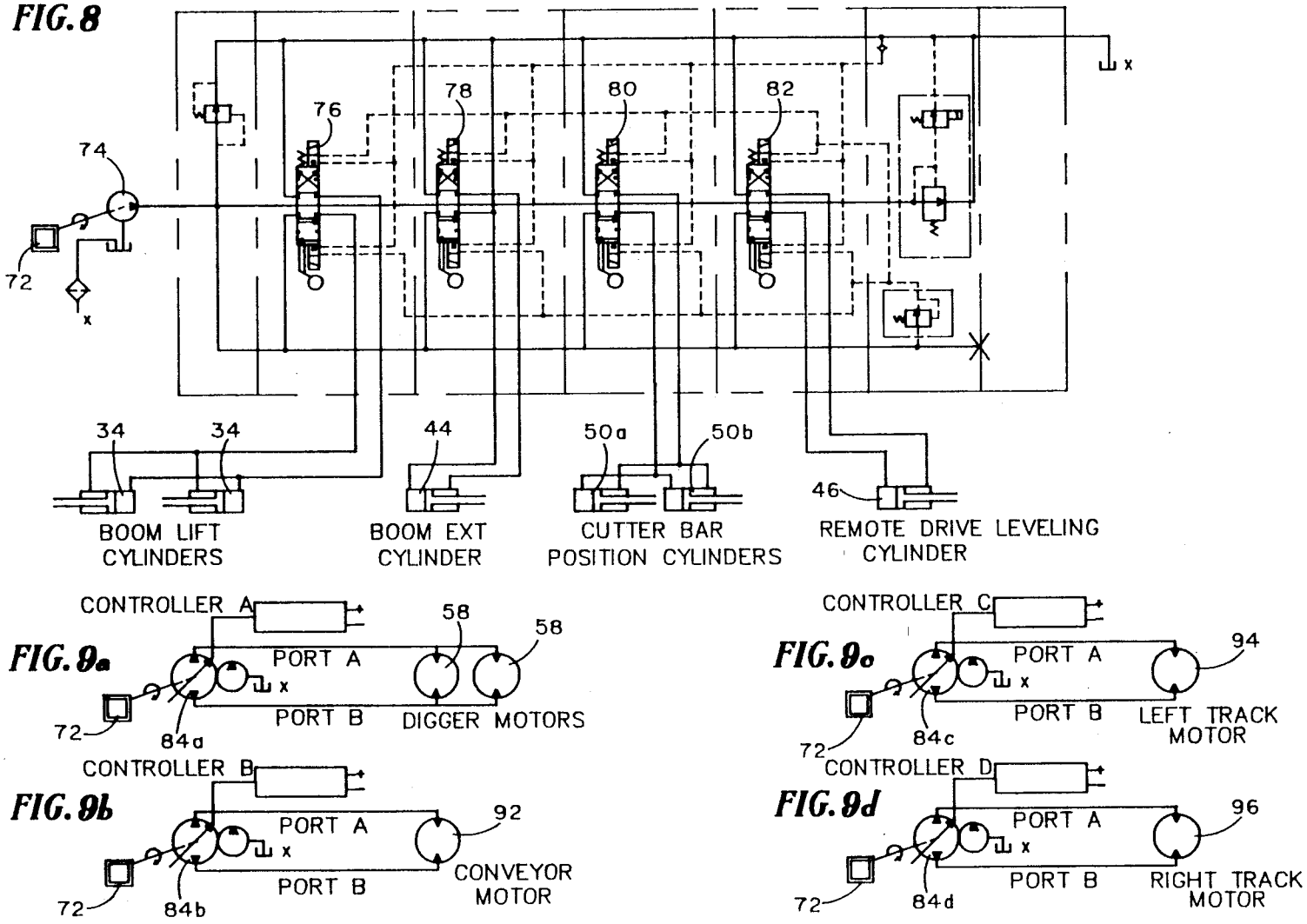
FIG. 8 is a schematic diagram of the hydraulic circuitry for controlling the trencher.
FIGS. 9*a*–9*d* are schematic diagrams showing the hydraulic circuitry for controlling the cutter bar motors, the conveyor motor, and the left and right track motors of the trencher.

The undercut trenching machine is powered by an internal combustion engine 72 which operates a hydraulic pump 74, illustrated schematically in FIG. 8. The pump 74 provides hydraulic fluid under relatively low pressure to an open loop hydraulic system which includes a plurality of electrically operated hydraulic control valves. A boom lift control valve 76 directs pressurized hydraulic fluid to extend and retract the boom lift cylinders 34. Similarly, a boom extension control valve 78 controls the boom extension cylinder 44; a cutter bar control valve 80 controls the cutter bar position cylinders 50*a* and 50*b*; and a leveling control valve 82 controls the leveling hydraulic cylinder 46.

Figure 10:
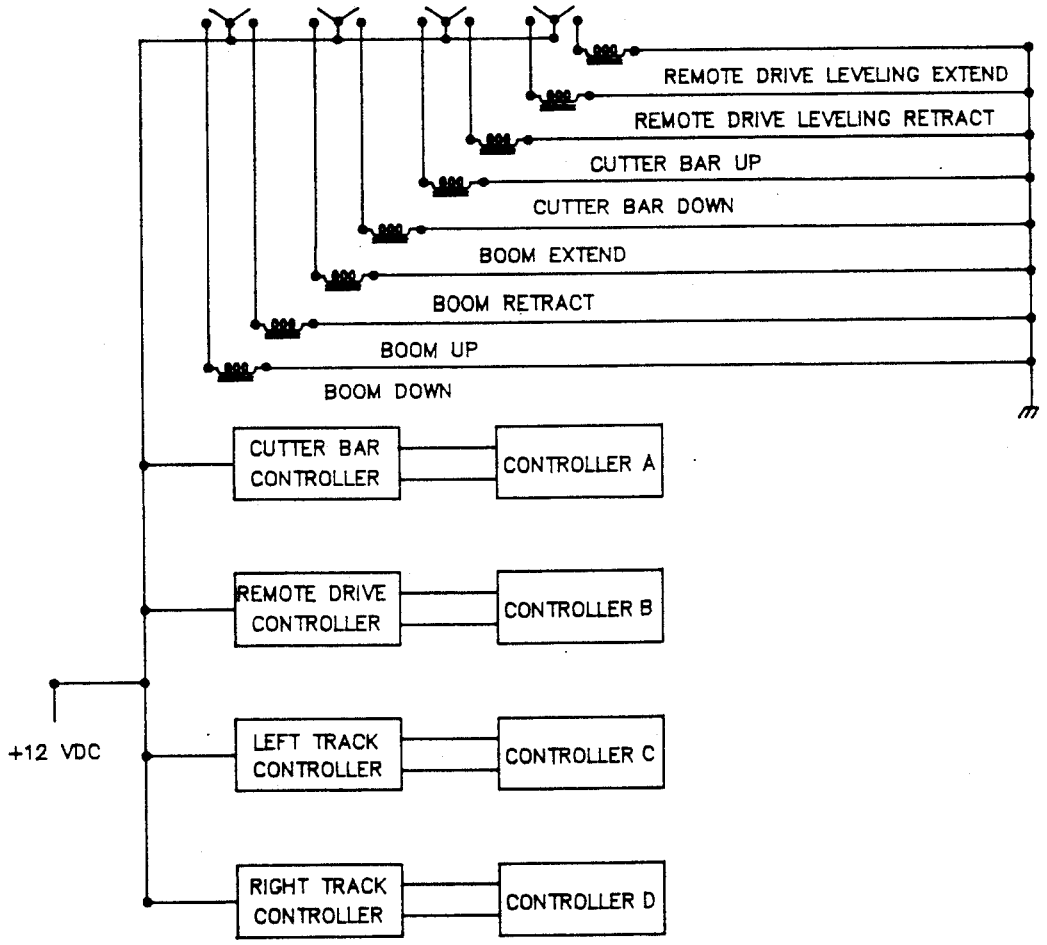
FIG. 10 is a schematic diagram of the electrical circuitry for controlling the trencher.

The hydraulic control valves 76–82 are each operated by a corresponding normally open rocker switch 84–90, shown schematically in FIG. 10. Spring-biased to the open position, the switches 84–90 when closed to either side will energize a solenoid to shift a valve spool of the corresponding hydraulic control valve 76–82 to effect the desired motion.

The internal combustion engine 72 also drives a plurality of high pressure variable displacement pumps 84*a*–84*d*, illustrated schematically in FIGS. 9*a*–9*d*, which are part of a closed loop, high pressure hydraulic system. The variable pumps 84*a*–84*d* are each electrically controlled by a controller A–D in the conventional manner (FIGS. 9*a*–9*d* and FIG. 10). Controller A is operated to selectively direct high pressure hydraulic fluid to the chain drive hydraulic motors 58 to control the direction and speed of travel of the cutter chain. Similarly, controller B is operated to control a hydraulic motor 92 for driving the conveyor 98, and controllers C and D are operated to control a left and right track hydraulic motor 94 and 96, respectively, to control the direction of the tractor unit.

Digging of a trench with the undercut trenching machine 20 typically begins at an angle selected by the operator and corresponding to site conditions. If, for example, the trench is to be started adjacent to a building, the cutter bar 48 may be extended rearwardly of the remote drive unit 28, as illustrated in FIG. 6. The cutter chain 52 is activated to rotate in the direction of the arrow in FIG. 6. The boom 30 is lowered by retracting cylinders 34 (FIG. 3) to urge the cutter bar 48 into the ground and the leveling cylinder 46 is retracted to maintain the remote drive unit 28 approximately level. The cutter bar 48 is moved over time by the cutter bar cylinders 50*a* and 50*b* to an operative position wherein it extends downwardly and forwardly of the remote drive unit 28, as illustrated, for example, in FIG. 1.

In the operating undercut trenching position, the sprocket 56 for supporting the cutter chain at the upper end of the cutter bar, has the axis thereof, as illustrated in FIG. 1, located at substantially the horizontal level of the axes of rotation for the tracks 24*a* and 24*b*. As a result, substantially the full forward facing length or side of the cutter chain 52 is positioned below the ground surface whereby to assist the efficiency of the overall trenching operation.

Removal of earth to create the trench occurs from the lowest point of extension of the cutter chain 52 and extends along the upwardly and forwardly facing edge or face of the cutter bar 48. The cupped teeth 68 and box 60 of the cutter chain 52 (FIG. 7) combine to form a conveying container for spoil loosened during trenching. Loosened spoil drops into the conveyor boxes of the cutter chain and is thus conveyed by the cutter chain 52 upwardly and rearwardly to the remote drive unit 28 and the conveyor 98 (FIGS. 2 and 5) which diverts it to either side of the trench.

Figure 11:
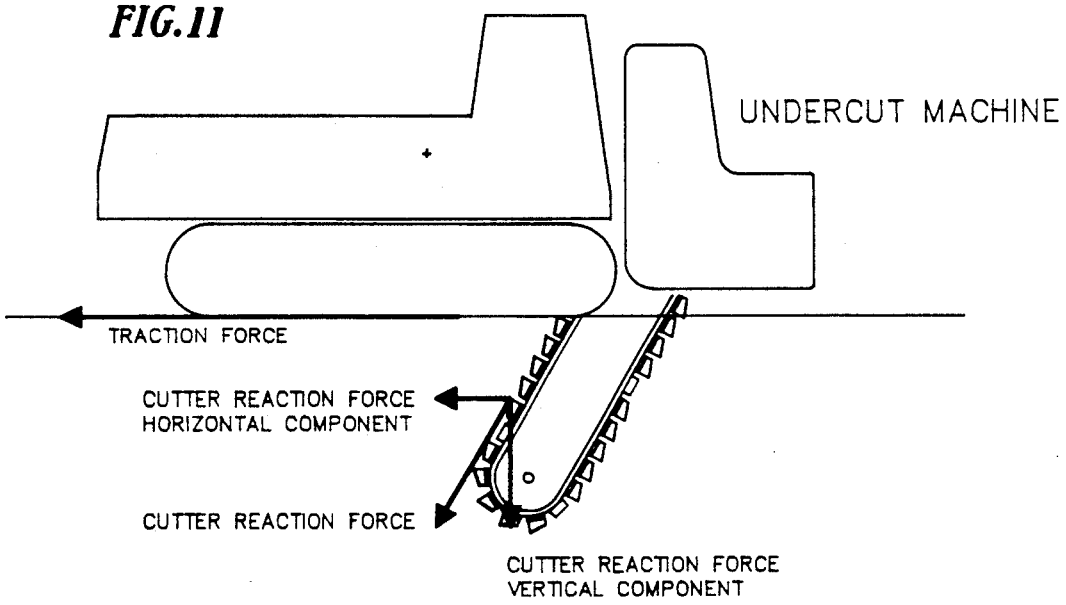
FIGS. 11 and 12 are diagrammatical views of the undercut trencher and a conventional trencher showing the reaction forces on the cutter chain during operation.
Figure 12:
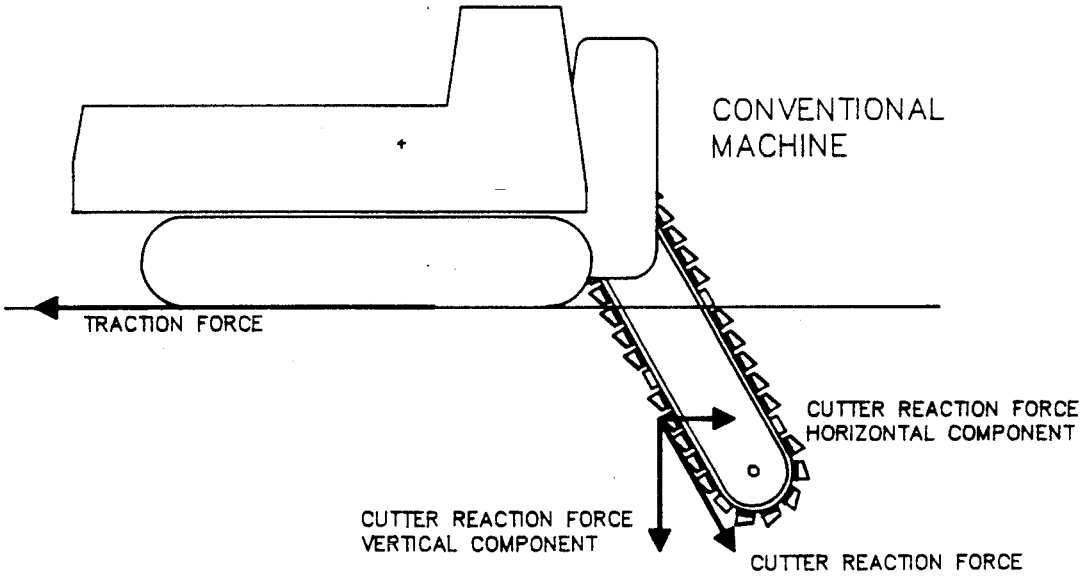

Reaction forces on the drive chain of the undercut trencher unit of the present invention have different components than the reaction forces on cutter chains of conventional trenchers (FIGS. 11 and 12). The traction force of the tractor unit of both trenchers points, of course, in the forward direction of travel. The horizontal component of the undercut trencher cutter chain (FIG. 11) points in the same, forward direction whereas the same component of the conventional trencher (FIG. 12) points in the opposite, rearward direction. Less tractive force, accordingly, is required to advance the undercut trencher than the conventional trencher. Moreover, because the horizontal component is in the direction of trenching, penetration of the cutter bar into the earth, especially hard or rocky soil, is improved.

In a conventional trencher, the amount of force that can be exerted on the cutter bar to effect penetration or advancement of the trench is dependent on the design of the trencher, but in no event can exceed the weight of the machine. Moreover, the face of the trench being cut by a conventional machine forms a ramp which is inclined upwardly and in the direction of travel of the trencher. If the penetration force needed for cutting is greater than that exerted on the cutter bar by the trencher, the cutter bar will be pulled up the inclined face of the trench. The undercut trenching machine, in contrast, produces a reverse incline opposite to the direction of travel of the undercut trencher. The soil to be trenched is, accordingly, trapped or wedged between the cutter bar and the ground-supported tractor unit. Because the tractor unit cannot be forced downwardly, any tractive force is transferred to the cutter chain and teeth to improve the penetration or trench advancement rate of the trencher. The cutting force is dependent on the tractive force exerted on the cutter bar and against the reverse incline of the trench face and is therefore independent of the weight of the trenching machine.

In the conventional trencher, spoil is dragged to the surface by the cutter chain against the face that is being cut. A "dirt plate" is generally used to provide an incline above the surface of the ground against which the spoil is further dragged upwardly and onto the conveyor. Rocks tend to catch at the edge of the plate or be wedged in the throat region between the dirt plate and the cutter chain in the region of the sprocket. Because the undercut trencher conveys the spoil to the surface on the cutter chain, less energy is required to remove the spoil. By eliminating the dirt plate, the undercut trencher is less likely to stall on wedged rocks and the power loss associated with dragging the spoil along the dirt plate is avoided. Additionally, the efficiency of removing spoil by conveying is less dependent on the speed of the cutter chain than is the dragging and kicking of the spoil toward ground level by the conventional trencher so that a much lower speed of travel of the cutter chain can be used. Reduced cutter chain speed acts to reduce the wear and vibration associated therewith.

A conventional trencher cuts along the downwardly and forwardly facing edge of the cutter bar. Stones and other buried objects tend to be driven downwardly by the action of the cutter chain. This action also tends to compact the earth in forward proximity of the cutter bar, thus making its subsequent release and removal more difficult. In contrast, the undercut trencher tends to fracture the earth which then falls into the conveyor boxes of the cutter chain where it is removed.

Removal of spherical objects, such as stones buried in the soil, is much improved in the undercut trencher. A conventional trencher tends to roll the stones and "bounce" on them as the cutter chain tries to loosen them from the soil and drag them to the surface. The undercut trencher more quickly loosens the stones from below and more efficiently carries them to the surface atop the chain and in the boxes.

The inefficiency in removing spoil of conventional trenchers results in an accumulation of spoil in the area of the cutter bar, some of which passes around or through the cutter chain where it is carried into the drive sprocket where it may interfere with operation of the trencher. Recirculation of spoil is reduced with the undercut trencher wherein the cutter chain acts as a conveyor of spoil outside the trench.

Figure 13:
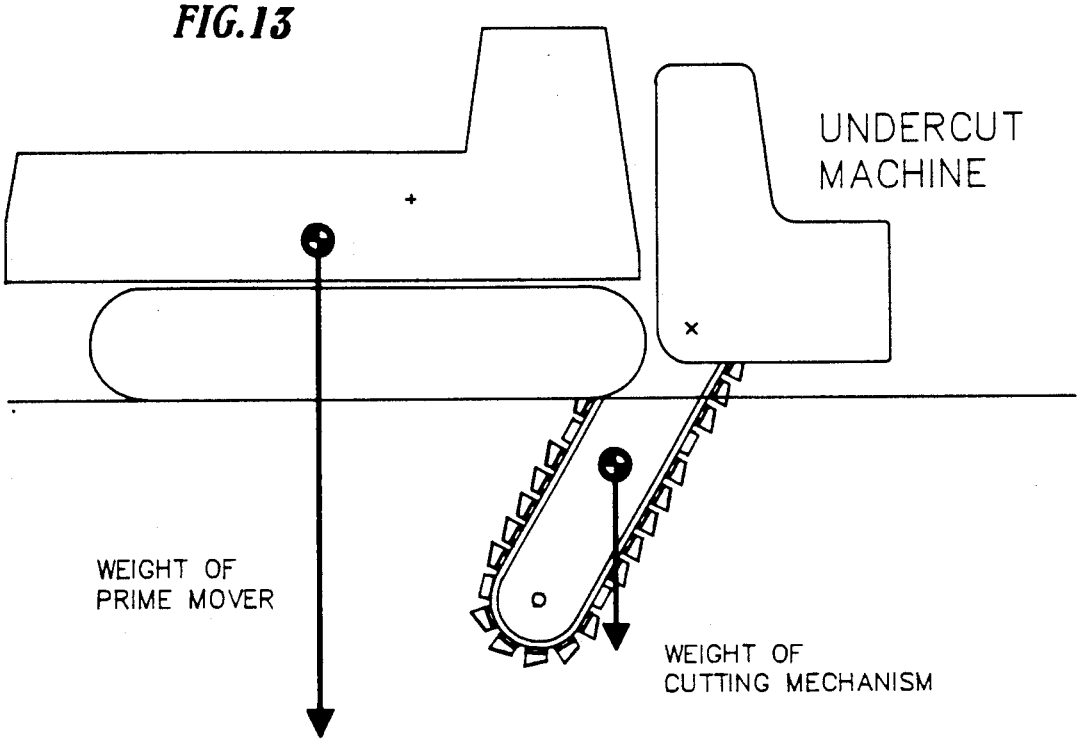
FIGS. 13 and 14 are diagrammatical views of the undercut trencher and a conventional trencher showing the location of weight of the cutting mechanisms during operation.
Figure 14:
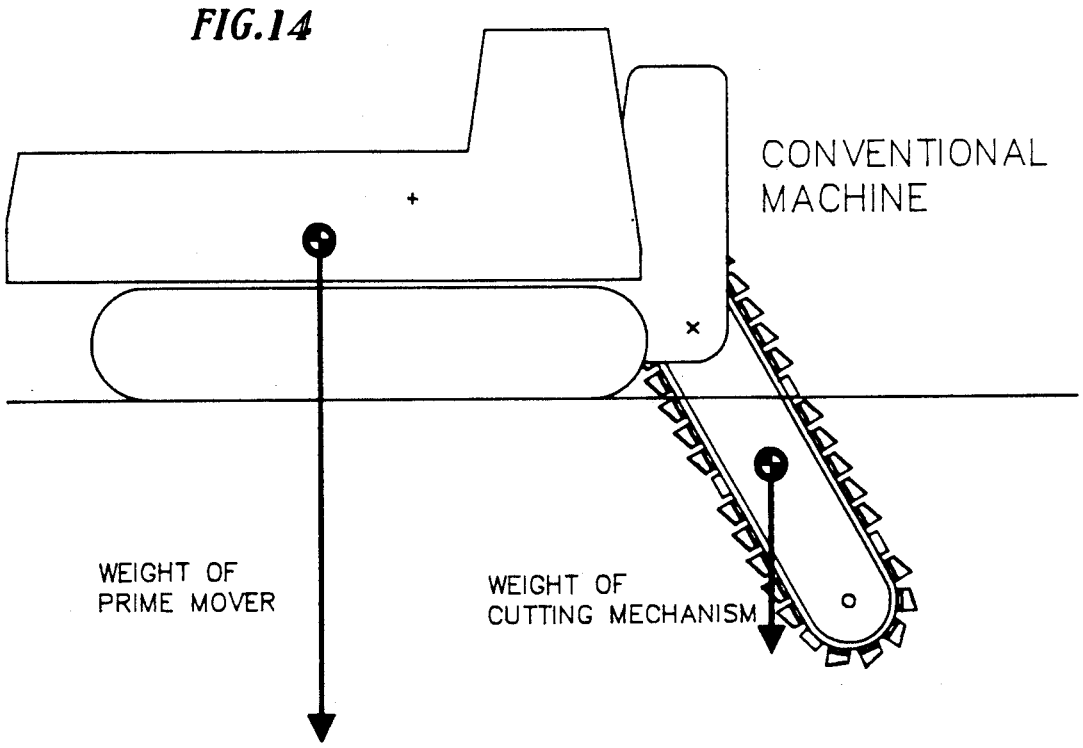

As illustrated in FIGS. 13 and 14, the undercut trencher moves the center of gravity of the cutter mechanism closer to the tractor unit, thereby improving the traction and stability of the machine. The improved penetration ability of the undercut trencher further enhances stability during trenching by making it less likely that an operator will place the weight of the machine on the cutting mechanism, a position that causes severe vibration and shaking and may tip the machine sideways.

In the conventional trencher, additional force applied to the cutter bar tends to unweight the tractor unit thereby reducing the tractive force that can be exerted by the tractor unit and possibly raising the rearward end of the tractor unit off of the ground. In contrast, force applied to the cutter bar of the undercut trencher will increase the effective weight of the tractor unit thereby increasing the traction that can be exerted. Such additional force on the cutter bar and of the tractor unit may assist greatly in the efficiency of trenching, particularly in difficult soils.

It should be clear from the foregoing description of a preferred embodiment that other means could be employed in accomplishing the broad purposes of the invention. This description is intended to illustrate but not to limit the scope of the invention as defined in the following claims.

I claim:

1. An undercut trenching machine, including a prime mover having a main frame with ground-engaging rotatable traction means having axes extended transversely of the main frame, comprising:

(a) a cutter bar having an upper end portion and a lower end portion;

(b) means movably supporting the upper end portion of the cutter bar on the main frame for pivotal movement longitudinally of the main frame to an operating position inclined in a downward and forward direction;

(c) an endless cutter chain rotatably supported on said cutter bar;

(d) rotary means adjacent the upper end portion of said cutter bar for supporting said cutter chain having the axis of rotation thereof at substantially the horizontal level of the axes of said traction means when the cutter bar is in the operating position therefor, whereby a major portion of the cutter chain is below the ground surface, and (e) power means on said main frame for driving said rotary means to move the forward side of the cutter chain in an upward and rearward direction when the cutter bar is in said operating position.

2. An undercut trenching machine as defined in claim 1, wherein:

(a) said cutter chain is comprised of a plurality of interconnected links on each of which is mounted a box assembly having an open top side and an open leading side and at least one cutter tooth that projects laterally outwardly of said cutter chain.

3. An undercut trenching machine as defined in claim 2, wherein:

(a) said box assembly includes a base plate having a leading edge formed with a bevel surface and a trailing edge formed with a bevel surface for mating association with the beveled leading edge on the base plate of a next adjacent trailing box assembly.

4. An undercut trenching machine as defined in claim 2 wherein:

(a) said box assembly forms a receptacle for carrying spoil above the ground surface for disposal.

5. A trenching machine, including a ground-supported tractor unit, comprising:

(a) a cutter bar mounted for pivotal and vertical movement at the rearward end portion of the tractor unit;

(b) an endless cutter chain carried on said cutter bar, wherein said cutter chain is comprised of a plurality of interconnected links on which are mounted box assemblies;

(c) each of said box assemblies includes a base plate portion and cutter teeth projected outwardly of said cutter chain;

(d) the leading edge of each said base plate portion is beveled to project in the direction of travel of said cutter chain;

(e) the following edge of each said base plate portion is beveled so as to mate with said beveled leading edge;

(f) means for raising and lowering said cutter bar relative to the ground;

(g) means for pivoting said cutter bar relative to the tractor unit between a secondary operative position inclined downwardly and rearwardly of the tractor unit and a primary operative position inclined downwardly and forwardly of the rearward end portion of the tractor unit; and (h) means for driving said endless cutter chain.

6. An undercut trenching machine, including a ground supported prime mover, comprising:

(a) a cutter bar mounted for pivotal and vertical movement on the prime mover;

(b) an endless cutter chain carried on said cutter bar;

(c) a remote drive unit mounted on the prime mover wherein said cutter bar is mounted at one end thereof for pivotal movement on said remote unit;

(d) wherein said remote drive unit and said cutter bar are movable to a storage and transport position wherein the second, opposite end of said cutter bar is supported on the prime mover; and (e) means for driving said cutter chain such that when said cutter chin is inclined downwardly and in the direction of travel of the prime mover, the travel of said cutter chain while trenching is in a direction upwardly and opposite to the direction of travel of the prime mover.

* * * * *